US008382169B2

(12) United States Patent
Bosshard

(10) Patent No.: US 8,382,169 B2
(45) Date of Patent: Feb. 26, 2013

(54) DEVICE FOR SECURING DOORS USING MAGNETIC ATTRACTION

(75) Inventor: Viktor Bosshard, Fislisbach (CH)

(73) Assignee: Jos. Berchtold AG, Zurich (CH)

( * ) Notice: Subject to any disclaimer, the term of this patent is extended or adjusted under 35 U.S.C. 154(b) by 0 days.

(21) Appl. No.: 12/918,514

(22) PCT Filed: Feb. 17, 2009

(86) PCT No.: PCT/CH2009/000066
§ 371 (c)(1),
(2), (4) Date: Nov. 15, 2010

(87) PCT Pub. No.: WO2009/103177
PCT Pub. Date: Aug. 27, 2009

(65) Prior Publication Data

US 2011/0049911 A1 Mar. 3, 2011

(30) Foreign Application Priority Data

Feb. 20, 2008 (EP) ..... 08405052

(51) Int. Cl.
*E05C 17/56* (2006.01)
*E05C 19/16* (2006.01)

(52) U.S. Cl. ..... 292/251.5; 292/DIG. 15

(58) Field of Classification Search ..... 292/251.5, 292/DIG. 15
See application file for complete search history.

(56) References Cited

U.S. PATENT DOCUMENTS

| | | | | |
|---|---|---|---|---|
| 3,869,873 | A * | 3/1975 | Thomas | 62/275 |
| 4,631,776 | A * | 12/1986 | King | 16/82 |
| 4,702,038 | A * | 10/1987 | Frey | 49/478.1 |
| 4,995,655 | A * | 2/1991 | Freeman | 292/251.5 |
| 5,309,680 | A * | 5/1994 | Kiel | 49/478.1 |
| 5,887,917 | A * | 3/1999 | Luciana | 292/251.5 |
| 5,890,751 | A * | 4/1999 | Seffinga | 292/67 |
| 6,321,411 | B1 * | 11/2001 | Ikejiri et al. | 16/82 |
| 7,114,293 | B2 * | 10/2006 | Purlee | 49/470 |
| 7,360,804 | B1 * | 4/2008 | Fidali et al. | 292/262 |
| 7,986,525 | B2 * | 7/2011 | Wang | 361/679.59 |
| 2011/0101711 | A1 * | 5/2011 | Della-Santa | 292/251.5 |

FOREIGN PATENT DOCUMENTS

| | | |
|---|---|---|
| JP | 11-287062 | 10/1999 |
| JP | 2000-192707 | 7/2000 |

* cited by examiner

*Primary Examiner* — Carlos Lugo
(74) *Attorney, Agent, or Firm* — Rankin, Hill & Clark LLP

(57) ABSTRACT

A device for securing or stopping a door relative to a stationary structure by means of magnetic attraction. In a secured position, a tilt element engages a counter-element due to magnetic attraction between the first magnetic element and the second magnetic element, and the door is stopped and optionally fixed in place, while in a retracted position the tilt element is retracted and the door can be moved. The tilt element includes a cover plate made of non-magnetic solid material and can be installed both on the stationary structure, such as the floor, wall or ceiling, or in the door.

12 Claims, 1 Drawing Sheet

DEVICE FOR SECURING DOORS USING MAGNETIC ATTRACTION

BACKGROUND OF THE INVENTION

1. Field of the Invention

The subject matter of the present invention is a device according to the generic term of the first independent patent claim and which is used to secure doors by means of magnetic attraction.

2. Description of Related Art

Magnetic door stoppers are known from prior art, having magnetic parts installed in the door and in the floor and resulting in a door being stopped as it moves across the magnetic part positioned in the floor.

By way of example, inter alia, CH 383,822 discloses a stop device in which a permanent magnet, which is installed in the door, raises a moving ferromagnet, which is incorporated in the floor, and draws it into a slot in the door which is constructed for this purpose. This stops further movement of the door in the same direction. However, the magnetic attraction force of a conventional permanent magnet is too weak to also secure the door.

U.S. Pat. No. 6,321,411 deals with this problem and discloses a magnetic door stopper which consists of a floor component with a moving ferromagnetic platelet and a door component. The door component contains not only a magnet but also an elastic element, wherein the moving platelet of the floor component engages in this door component by means of magnetic attraction, and is additionally arrested by means of the elastic element. In this and other conventional variants, the moving part which is mounted on the floor is composed of magnetic or ferromagnetic material, whose susceptibility to corrosion and visual appearance are disadvantageous.

The object of the present invention is to provide a countersunk magnetic arresting device which eliminates said disadvantages of the prior art.

BRIEF SUMMARY OF THE INVENTION

The device according to the invention for arresting or stopping a door relative to a stationary structure by means of magnetic attraction comprises at least one tilting element and one counter element, in which the tilting element engages in the event of magnetic attraction. In an arresting position, the tilting element engages in the counter element and the door is stopped or arrested, whereas in the lowered position, the tilting element is retracted and the door is free to move.

In this case, the tilting element comprises a first magnet element and the counter element comprises a second magnet element, wherein at least one of these magnetic elements is a permanent magnet or electromagnet, while the other magnet element may be soft-magnetic or magnetizable, e.g. composed of ferromagnetic material. The tilting element and the counter element can move in relation to each other such that they can be brought into the arresting position by magnetic attraction between the first magnet element and the second magnet element, thus either preventing further relative movement between the door and the fixed-position structure, for example a construction element such as a floor, wall or ceiling, or at least stopping further movement in the same direction. Either the tilting element is mounted on or in the fixed-position structure and the counter element is mounted on or in the door or, conversely, the tilting element is mounted on the door and the opposing element is mounted on the fixed-position structure. In the latter case, the tilting element further comprises a cover plate composed of non-magnetic material, wherein the cover plate is flush with the surface of the fixed-position structure or rests on the surface of the fixed-position structure and flush with a possible bezel mounted on the fixed-position structure.

In this patent specification, "non-magnetic" basically means materials which are not permanently magnetic. Materials referred to as "non-magnetic" may nevertheless be magnetized or soft-magnetic.

With regard to the cover plate, this means that it may well suit the purpose of the invention to use a cover plate composed of non-magnetic material, but of material which can be magnetized. In preferred embodiments, however, the material of the cover plate is chosen such that it does not contribute significantly to the magnetic attraction between the magnet elements.

One advantage of the device according to the invention in comparison to many commercially available door stoppers, which are, in general, not based on magnetic attraction force, is that when not in the arresting position the tilting element is completely or almost completely counter-sunk. It therefore projects from the surface of the fixed-position structure only when it engages in the counter element and stops or arrests the door. Thus, and contrary to conventional protruding door stoppers, the installation according to the invention presents no risk of tripping and can be used without any problems in heavily frequented spaces. This is warranted by the various embodiments of the device according to the invention, whether fitted flush, or almost flush in the floor, in the ceiling or in the wall.

A further advantage of the device according to the invention when compared to the magnetic door stoppers known from prior art, which can likewise be countersunk, is the design of the tilting element, which is considerably more solid both with respect to mechanical loading and corrosion, in particular the protection of its exposed surfaces by the use of a more solid cover plate on the first magnetic element. This cover plate not only provides protection for the first magnet element, but also mechanical reinforcement of the tilting element. Furthermore, as the cover plate of the tilting element can be better matched to visible building parts, the application range of the device according to the invention considerably extends that of conventional door stoppers or arresting devices.

The securing device according to the invention is therefore used for stopping and possibly securing doors. In a predetermined embodiment of the device according to the invention, the choice of the size and of the energy product (equivalent to the energy density, SI unit $kJ/m^3$) of the permanent-magnet element or elements and the strength of the magnetic field of the electromagnetic element determines the magnitude of the restraining force by magnetic attraction for a door of a predetermined design. Thus, it may suffice only to stop the relevant door or also to secure it in the arrested position. It should be noted that the construction of the device, according to the invention, requires a permanent magnet or an electromagnet with an energy product, or a magnetic field, of sufficient force for the specific application situation, since the solid cover plate considerably weakens the magnetic attraction force which occurs at least partially between the first and the second magnetic elements even in the securing position.

Various applications and embodiments of the device according to the invention will be described in detail in the following text, although the invention is not restricted to the described forms. In particular, it is also within the scope of the invention to produce configurations of the device according to the invention which combine preferred aspects of various described embodiments.

In preferred embodiments, the counter element is installed in a door face at the bottom, and the tilting element is lowered into the floor at a desired place in such a manner that the door is arrested and possibly locked as soon as it passes over the tilting element. However, the tilting element can also be installed or mounted in or on a wall or a ceiling.

The device according to the invention is also suitable for arresting doors relative to stationary structures which are independent of buildings, such as fence posts or wall surfaces, on which a door or a gate is stopped or arrested.

In principle it is also possible to arrest doors of moving objects such as vehicles or cars with the device according to the invention, in which case the tilting element or the counter element is mounted on a wall, on a floor or on a top of a vehicle, rather than on a fixed-position structure.

In addition, the device according to the invention can also be used to arrest a door or a gate in two different positions, for example by mounting a counter element on the bottom face and a second counter element in the narrow front face of the door, with one tilting element being fitted correspondingly at a desired position in the ground, and the other tilting element being fitted at the other desired point e.g. on a wall or on a fence post. Of course, a plurality of tilting elements can be installed at any desirable positions on the same or on different fixed-position structures, and the same variability applies to the installation of the counter element(s), for example by one or two counter elements being fitted to the same face of the door, and so on. In applications such as these, the gate can be moved from one arresting position to the other by lightly pushing or pulling the door leaf and thus transcending the magnetic attraction force between the tilting element and the counter element. Advantageously, in applications such as these as well as in other applications, the device according to the invention simultaneously fulfills the function of a conventional door catch, wherein a user pushes or pulls directly the door leaf or a handle attached to the door. An embodiment such as this is particularly suitable, for example, for stopping and possibly arresting a low garden gate, which can thus be opened, at least in one direction, without the use of hands, without a catch, and even without a handle. In applications and embodiments such as these, it is, of course also possible to exchange the placing of tilting element and counter element on the door and the stationary structure.

In particularly simple embodiments, a swivel pin of the tilting element being anchored in one component, is retained in a swivel position, wherein the tilting element is embedded in a cavity either in the stationary structure or in the door. In the embedded position, the tilting element falls back into the cavity. It can also be drawn back into the cavity by a known means, such as a spring or a third magnetic element.

In further preferred embodiments of the invention, the cover plate projects beyond the first magnetic element, so that, in its lowered position, the protruding edge rests on the surface of the stationary structure while the first magnet element is retained in the cavity. In this case it is also possible for the stationary structure to comprise a complementary depression for the edge area resting on it, so that in the retracted position, the surface of the cover plate is flush with the surface of the stationary structure. One advantage of these embodiments of the device according to the invention, in which the cover plate rests on the surface of or in a depression in the surface of the stationary structure when in the retracted position, is the simple implementation of a cavity in the stationary structure, provided that it does not fall short of a minimal depth necessary to countersink the first magnetic element. This simplifies the installation in the floor, since the depth of the cavity and in particular the horizontal profile of the lower bottom surface of the cavity, are not critical, provided that the minimum depth is maintained.

In preferred embodiments of the device according to the invention, the tilting element is equipped with a housing. Although a tilting element without a casing may be termed an arresting element, the arresting element in these cases comprises the tilting element and a casing. In these embodiments comprising a housing, the tilting element can also be installed either in the stationary structure or in the door, wherein the housing can be at least partially counter-sunk. In one preferred embodiment of the invention, the tilting element is installed in the floor, in the wall or in the ceiling, and the counter element is installed in the door. In these embodiments with a housing, too, the cover plate preferably protrudes beyond the first magnetic element in its counter-sunk position, so that the protruding edge rests on the surface of or in a depression in the surface of the stationary structure while the first magnet element in its housing is at least partially lowered into a cavity in the fixed-position structure.

In a further preferred embodiment of the invention, the housing comprises a retractable substructure and a bezel. The sidewalls of the substructure define the cavity into which the tilting element drops or is drawn into the lowered position. For example, a substructure without a base is produced very easily and at low cost by sawing sections off a quadrilateral tube. Before being sawn off, holes for a swivel pin of the tilting element are drilled into the quadrilateral tube. The bezel rests on the substructure and on a surface of a building part, wherein the bezel is attached to the substructure e.g. by means of spot welds and attached to the building part by means of screws or adhesive.

The bezel and the cover plate of the tilting element are preferably composed of the same material and are aligned with each other such that the upper face of the cover plate is flush with the upper face of a bezel of the housing, as soon as the tilting element is in the retracted position. The thickness of both the bezel and the cover plate preferably ranges from 0.1 cm to 2 cm, and in further preferred embodiments does not exceed 0.5 cm or 1 cm. In addition, in preferred embodiments of the invention the outer edge of the panel is chamfered.

In preferred embodiments of the invention, the material for the cover plate and the bezel is a corrosion-resistant metal or a corrosion-resistant metal alloy, in particular a stainless steel or chromium steel. The same material is preferably used for the cover plate and for the bezel, wherein relevant aesthetic aspects relevant to specific applications can be considered as well as the solid characteristics such as resistance to cleaning processes, and if appropriate weather resistance. For certain applications, and in particular for installation in the ceiling area and wall area, cover plates and/or bezels composed of color-coordinated sturdy, in particular impact-resistant, plastic, hardboard or other materials.

In a further preferred embodiment, the cover plate of the tilting element and the bezel of the housing are equipped with a chromium steel plate of the same thickness. This preferred embodiment distinguishes itself through high quality of mechanical robustness, of corrosion resistance and of visual appearance, while at the same time being particularly simple and therefore cost-effective both for production and for fitting of the tilting element.

Further preferred embodiments of the securing element of the device according to the invention, with or without a housing, which are mounted on the wall or on the ceiling, are equipped with a third magnet element. This acts as a return magnet and draws the tilting element back into the concealed position when the tilting element is not engaged in the counter element. The third magnet element is usually a part of the substructure of the housing and can, for example, be integrated in a housing wall or in a housing base. Either at least the first magnet element is a permanent magnet or electromagnet, wherein the second magnet element and possibly the third magnet element can also be soft-ferromagnetic, or the second and the third magnet elements are a permanent magnet or an electromagnet, if the first magnet element is a soft-ferromagnetic element. This ensures that for the magnetic attraction required depending on the position, at least one of the magnet elements is a permanent magnet or an electromagnet. These embodiments are preferably designed such that the magnetic attraction between the first and the second magnet elements is stronger than that between the first and the third magnetic elements. Of course it is also possible to use a mechanical instead of a magnetic return mechanism, for example by means of a spring.

Conventional permanent magnets such as hard ferrite or commercially available plastic-bonded magnet materials with an energy density of, for example, less than 100 kJ/m$^3$ cannot be used for most installation situations since the space available for an installation in a door or for a fitting of a magnetic element in a practical location in the building part is not sufficiently large to accommodate a conventional permanent-magnet body of the necessary size therein. In preferred embodiments of the invention, therefore, permanent magnets with high-energy magnetic materials with an energy product of at least 150 kJ/m$^3$, preferably at least 200 kJ/m$^3$ or at least 250 kJ/m$^3$ are used. Magnetic materials such as these comprise, for example, compounds which contain elements of the rare earths. Known high-energy magnetic materials such as samarium-cobalt or preferably, neodymium-iron-boron are used in particular. If a very strong high-energy magnet is used, it may be preferable not to install this as the first or second magnetic element in the floor in order to preclude the possibility of an attraction effect on ferromagnetic parts in shoes.

In preferred embodiments of the invention, the counter element comprises a reinforcing element for the absorption and distribution of the forces generated when the tilting element engages in the counter element. Depending on the design, this reinforcing element can carry out various functions, in particular attachment and protection of the second magnet element, reinforcement of the door at the point where the cavity for the counter element was created, absorption of the forces which can be generated when a door slams upon the tilting element, and distribution of these forces across a larger area, as well as protection of the door material located underneath. For example, a reinforcing element protecting the second magnet element consists of a metal plate with a larger surface spread than the adjacent surface of the second magnet element, so that it can be fitted in the door by a plurality of screws. In a similar way, a metal plate which is larger than the impact surface of the engaging tilting element can distribute the generated forces across a larger area in the door, which is particularly relevant because the door is significantly weakened in the region where the cavity is created for the engagement of the tilting element. This reinforcement is a further advantage of the device according to the invention compared to devices known from the prior art. A preferred embodiment of a reinforcing element covers both sides of the notch in the door and is a one-piece construction, for example manufactured from an angled metal sheet or angled profile, wherein one arm of the angled profile serves to absorb and to better distribute the forces which occur upon engagement of the tilting element, and the second arm covers the second magnet element toward the engaging tilting element. In a further preferred embodiment of the reinforcing element, it comprises a buffer area composed of elastic material, which may cover one or both arm areas.

The devices according to the invention are preferably also used for fire safety doors. For example, a door is held open and, in the event of fire closed by a remotely controllable door closer, and in the latter case engages with a device according to the invention. The arresting element can be fitted without any problems in the middle of the floor of a frequently used hallway since it can be installed flush or virtually flush with the floor surface.

In preferred embodiments of the invention, the first and/or second magnetic element comprises an electromagnet, in which case care should be taken to ensure that the choice of the magnet core and of the current level achieves sufficiently strong magnetic attraction between the magnet elements in order to overcome the attenuating effect of the cover plate which separates the magnet elements.

Variants of the device according to the invention with a magnetic element which is electromagnetic can in principle be combined with other preferred embodiments. Since the magnetic attraction force of the electromagnets can be adjusted by controlling the current supply, such devices according to the invention are also used, in particular, for fire safety doors. In one exemplary application, a fire safety door under current is normally held open by means of a securing element of a first device according to the invention comprising an electromagnet. In the event of fire, the door automatically closes due to the current supply being interrupted, and engages with the securing element of a second device according to the invention comprising a permanent magnet.

Particularly in the application field of fire safety doors, but also in other applications of the device according to the invention, this can be combined with a door closer. By way of example, a door is equipped with a door closer and an arresting device according to the invention, with the force of the door closer exceeding the restraint force of the arresting device. In a configuration such as this, the device according to the invention acts as a retractable door stopper in a classic situation, in which the door is to be closed automatically by the door closer. In an alternative configuration, the restraint force of the arresting device exceeds the force of the door closer acting upon the arresting device. In other words, in this case the door closer is weaker than the arresting device. In this configuration, the door remains open only when it is opened sufficiently for the tilting element to engage with the counter element, but closes automatically if not.

It is indeed within the scope of the invention to construct configurations of the device according to the invention, which combine preferred aspects of several different embodiments disclosed. For example, when used with double swing doors in a broad passageway, e.g. a hospital passageway, the double swing door is normally held open by the magnetic attraction force between two devices according to the invention, whose tilting elements are each equipped with an electromagnetic element and are installed at the edge of the passageway, in the floor, the wall or the ceiling. The magnetic attraction is produced only when a current is supplied, which is interrupted in the event of a fire, as a result of which the doors are closed with the aid of door closers. Two further devices according to the invention, each equipped with a permanent magnet and embedded in the floor or fixed to the ceiling in the middle of the passageway and thus in the most frequented area, that is to say in the zone which is used most, at the same time lock the doors that have closed.

BRIEF DESCRIPTION OF THE DRAWINGS

Preferred embodiments of the invention will be explained with reference to the following schematic figures

DETAILED DESCRIPTION OF THE INVENTION

Figure 1:
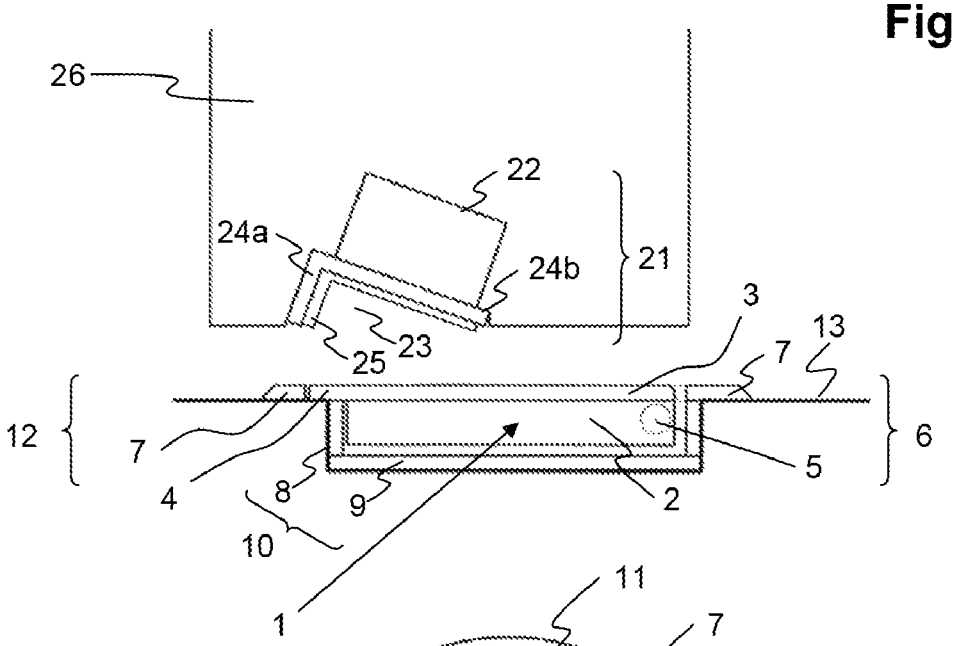
FIG. 1 shows a section through one preferred embodiment of the device according to the invention in a lowered position, in which a tilting element is retracted in a housing.
Figure 2:
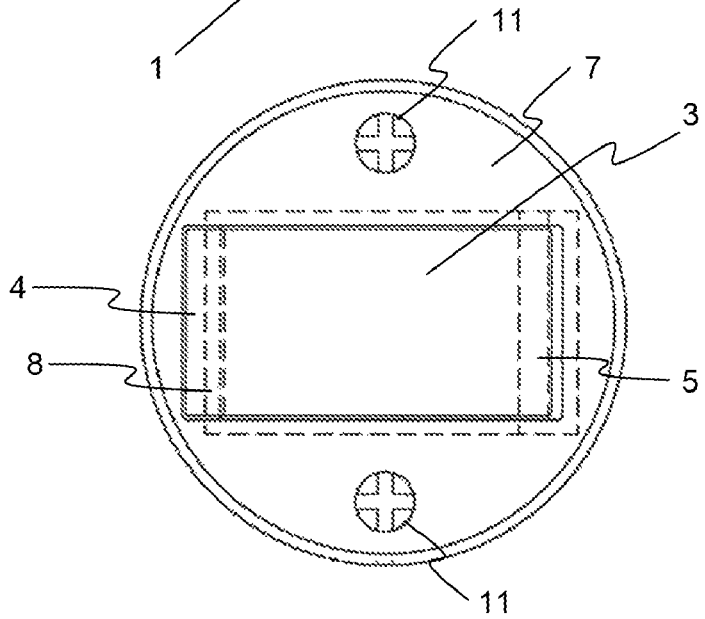
FIG. 2 shows a view of the tilting element of this preferred embodiment of the invention, with the tilting element in the recessed position.
Figure 3:
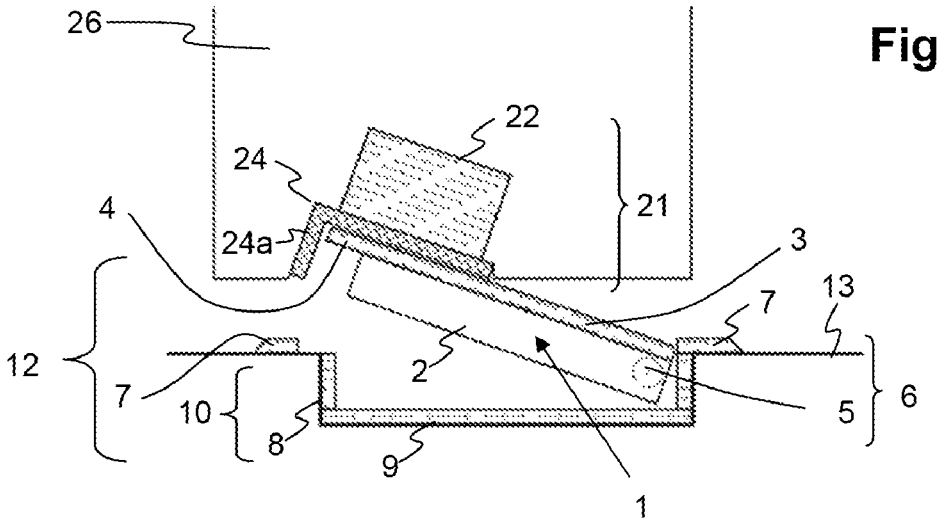
FIG. 3 shows a section through this preferred embodiment of the apparatus according to the invention in a securing position, showing the tilting element engaged with a counter element.

FIGS. 1 to 3 show one preferred embodiment of the invention, in which the same numbers in each case denote the same parts: a tilting element 1 is installed in the floor and equipped with a cover plate 3 composed of chromium steel and with a counter-sunk housing 6 with a bezel 7, likewise composed of a chromium steel plate of the same thickness. The tilting element 1 and the housing 6 together form a securing element 12. However, a tilting element 1 used without a housing 6 can also be referred to as a securing element 12.

A counter element 21 is installed in the bottom end face or bottom edge of a door 26. A notch 23 in the counter element 21 is provided to accommodate the raised tilting element 1. The notch 23 is covered by an angle profile 24, for example composed of metal or plastic. In addition, the surface of the angled profile 24 is equipped with a buffer zone 25 of elastic material, such as rubber. FIG. 3 shows an exemplary embodiment without a buffer zone 25.

The tilting element 1 is equipped with a first magnet element 2, and the counter element 21 is equipped with a second magnet element 22. In the present embodiment of the invention, the second magnet element 22 is a permanent magnet.

FIGS. 1 and 2 show the securing element 12 in a counter-sunk position, with the cover plate 3 and the housing bezel 7 of the securing element 1 resting flat on a floor surface 13 and/or an upper edge of a substructure 10 of the housing 6, such that the first magnet element 2 is lowered in the floor, and the door 26 is free to move. The cover plate 3 is preferably firmly connected to the first magnetic element 2 and its edge area 4 protruding beyond the first magnet element 2, rests on the floor 13 or on the substructure 10. The protruding edge 4 is arranged on the side of the cover plate 3 arresting device opposite a hinge 5. The housing wall 8 preferably consists of a piece of a quadrilateral tube, for example composed of metal or plastic, with holes for the swivel pin 5, which passes through the housing wall 8 and the first magnet element 2. The tilting element 1 can tilt around the swivel pin 5 by an angle of around 15° to 30°, or preferably up to 45° or 60°, or up to a maximum of 90°. An optional housing base 9 is attached to the lower end face of the housing wall 8. The housing wall 8 and the optional housing base 9 together form the substructure 10 of the housing 6 of the securing element 12. A gap for the cover plate 3 is cut out in the bezel 7 of the housing 6. The bezel 7 is connected to the upper end face of the substructure 10, for example, by a plurality of spot welds. The bezel 7 can be attached to the floor surface 13 by screws 11.

FIG. 3 shows the securing element 12 in an arresting position in which the door 26 is secured, that is to say stopped or held. In this case, the tilting element 1 engages by magnetic attraction between the first magnet element 2 and the second magnet element 22 in the counter element 21 in the door 26. In this case, the cover plate 3, which is firmly connected to the first magnetic element 2, engages in a notch 23 in the counter element 21. When the cover plate 3 of the tilting element 1 impacts on the counter element 21, the shorter arm 24*a* of the angled profile 24 reinforces the notch 23 of the opposing element 1 of the arrested door 26, and the longer arm 24*b* protects and secures the second magnet element 22 of the counter element 21 in the door 26.

LIST OF REFERENCE SYMBOLS

1. Tilting element
2. First magnet element
3. Cover plate of the tilting element
4. Protruding edge of the cover plate, which rests on a floor,
5. Swivel pin
6. Housing for tilting element
7. Bezel of the housing
8. Housing wall
9. Housing base
10. Substructure of the housing
11. Screw
12. Securing element
13. Surface of the floor
21. Counter element
22. Second magnet element
23. Notch
24. Angled profile (24.*a* shorter arm, 24.*b* longer arm)
25. Buffer area composed of elastic material
26. Door

The invention claimed is:

1. A device for securing a door relative to a stationary structure by means of magnetic attraction, comprising:
- a tiltable tilting element with a first magnet element,
- a counter element with a second magnet element, and
- a housing for the tilting element, in which the tilting element is retracted when it is not engaged in the counter element,
- wherein the housing is positioned on the stationary structure,
- wherein at least one of the first and second magnet elements is a permanent magnet or electromagnet, and
- wherein the tilting element and the counter element are movable with respect to one another such that they can be moved to a securing position by magnetic attraction between the first magnet element and the second magnet element,
- wherein the device further comprises a bezel that overlaps the stationary structure and the housing,
- wherein the tilting element is pivotally attached to the housing and the counter element is mounted on the door, and
- wherein the tilting element comprises a cover plate composed of non-magnetic material, wherein, when not in use, an edge of the cover plate rests on the stationary structure and on an upper edge of the housing and is aligned with a surface of the bezel or protrudes by no more than the thickness of the cover plate resting thereon, beyond the surface of the bezel.

2. The device for securing a door as claimed in claim 1, wherein the cover plate and the bezel of the housing are composed of the same material, which is non-magnetic or cannot be magnetized.

3. The device for securing a door as claimed in claim 1, wherein the material of the cover plate, which is non-magnetic or cannot be magnetized, and also of the bezel are/is a corrosion-resistant metal or metal alloy, in particular a stainless steel or chromium steel, or a plastic.

4. The device for securing a door as claimed in claim 1, wherein at least one of the magnet elements is a permanent magnet.

5. The device for securing a door as claimed in claim 4, wherein, the permanent magnet has an energy product of at least 150 $kJ/m^3$.

6. The device for securing a door as claimed in claim 1, wherein at least one magnet element is an electromagnet.

7. The device for securing a door as claimed in claim 1, wherein the counter element comprises a reinforcing element for absorbing and distributing the forces which occur on engagement of the tilting element.

8. The device for securing a door as claimed in claim 7, wherein the reinforcing element is an angled profile, wherein one arm of the angled profile is used to absorb the forces which occur on engagement of the tilting element, and the second arm covers the second magnet element in the direction of the engaging tilting element.

9. The device for securing a door as claimed in claim 7, wherein the reinforcing element comprises a buffer area composed of elastic material.

10. A door having a door closer and a securing device as claimed in claim 1, wherein the force of the door closer is greater than the restraint force of the securing device.

11. A door having a door closer and a securing device as claimed in claim 1, wherein the restraint force of the securing device is greater than the force of the door closer.

12. A fire safety door, which can be closed by a door closer and is locked in the closed state by a securing device as claimed in claim 1.

* * * * *